United States Patent [19]

Romagnoli

[11] 4,172,564

[45] Oct. 30, 1979

[54] APPARATUS FOR JOINING, WITHOUT STOPPING, THE TAIL END OF A WEB FROM A DEPLETED COIL TO THE LEADING END OF A FRESH COIL

[75] Inventor: Andrea Romagnoli, S. Lazzaro di Savena, Italy

[73] Assignee: IMA - Industria Macchine Automatiche SpA, Bologna, Italy

[21] Appl. No.: 877,537

[22] Filed: Feb. 13, 1978

[30] Foreign Application Priority Data

Aug. 25, 1977 [IT] Italy ..... 3535 A/77

[51] Int. Cl.[2] ..... B65H 19/14; B65H 19/08

[52] U.S. Cl. ..... 242/58.3; 156/504

[58] Field of Search ..... 242/58.3, 58.4, 58.1, 242/58.2, 58.5; 156/502, 504, 507

[56] References Cited

U.S. PATENT DOCUMENTS

| | | | |
|---|---|---|---|
| 1,936,916 | 11/1933 | Richter | 242/58.3 X |
| 3,030,043 | 4/1962 | Pinkham | 242/58.3 |
| 3,278,131 | 10/1966 | Hiepmann | 242/58.1 |
| 3,398,911 | 8/1968 | Poupin | 242/58.4 |
| 3,738,587 | 6/1973 | Cristiani | 242/58.1 |
| 3,886,031 | 5/1975 | Taitel | 242/58.4 |

*Primary Examiner*—Edward J. McCarthy
*Attorney, Agent, or Firm*—Karl F. Ross

[57] ABSTRACT

An apparatus for joining, while in continuous movement, (trailing) end of a web from a depleted coil to the leading end of a fresh coil comprises on a supporting frame a bonding station including a bonding cylindrical segment, a cylindrical surface mating therewith and a lever and arm assembly actuated to cause the cylindrical segment to be moved toward the mating surface in order to bond the tail end and leading end edges to each other.

5 Claims, 2 Drawing Figures

APPARATUS FOR JOINING, WITHOUT STOPPING, THE TAIL END OF A WEB FROM A DEPLETED COIL TO THE LEADING END OF A FRESH COIL

FIELD OF THE INVENTION

This invention relates to an apparatus for joining without stopping, the tail end or trailing of a web of a coil being exhausted (depleted coil) to the leading end of a fresh coil.

BACKGROUND OF THE INVENTION

Paper web, generally wound in rolls or coils which can be of considerable size, is currently widely employed in many different fields, and especially in the product packaging field. In particular, for preparing tea bags, a type of coiled paper is used which comprises a layer of filtering paper one side of which is coated with a suitable film which becomes adhesive (tacky) when raised to a given temperature.

To provide a continuous supply of such a web to the packaging machine, apparatus is known which can carry simultaneously two paper coils, one serving to fee the web while the other held in reserve. Such apparatus is equipped with a station at which the trailing edge of the coil being depleted is bonded to the leading edge of the reserve coil, so that the web can be supplied continuously to the packaging machine.

However, in such prior-art apparatus, to enable the tail edge or end of the coil being used to be connected to the leading edge or end of the fresh coil, it is necessary to stop the packaging machine. This represents a functional drawback of considerable importance as well as a potential source of errors or failure seriously affecting the quality of the subsequent package.

OBJECTS OF THE INVENTION

Therefore, it is a primary object of this invention to provide an apparatus for carrying out on the fly, i.e. during continuous movement of without stopping the coils and packaging machine, the joining of the end of a depleted coil to the end of a fresh coil.

A further object of the invention is to provide such an apparatus which is of simple construction, thereby combining the advantages of an economical manufacturing process with those afforded by an accurate and highly reliable operation.

SUMMARY OF THE INVENTION

These objects are achieved by an apparatus for joining without stopping the tail end of a web from a depleted coil to the leading end of a fresh coil, comprising a support frame for a pair of coils of a web, means for unrolling the web material from one of these coils, a station for bonding the tail-end edge of the depleted coil to the leading-end edge of the reserve coil, and means for cutting web material located upstream of said bonding station. The bonding station according to the invention comprises a bonding cylindrical segment journaled along its horizontal axis to an oscillatable arm carried by the support frame, a mating cylindrical surface for said cylindrical segment rotatable about an axis parallel to the axis of said segment, means for guiding the tail-end edge of the depleted coil being exhausted and the leading-end edge of the reserve coil to be unrolled between said cylindrical segment and said mating surface tangentially to the latter, and control means operative to cause said cylindrical segment to be approached to said mating surface in order to bond the intervening edges to each other.

BRIEF DESCRIPTION OF THE DRAWING

Further features will become apparent from the following detailed description of a preferred embodiment of the apparatus according to the invention, illustrated by way of example in the accompanying drawing, where.

SPECIFIC DESCRIPTION

A first coil 1*a* and a second coil 1*b* of a web material are mounted along parallel axes which lie in the same horizontal plane upon a supporting frame 2. The web material may be, for example, a web of so-called filter paper for preparing tea bags and comprising, as mentioned above, a layer of filter paper coated with a film of a heat-sealable adhesive or bonding agent.

Figure 1:
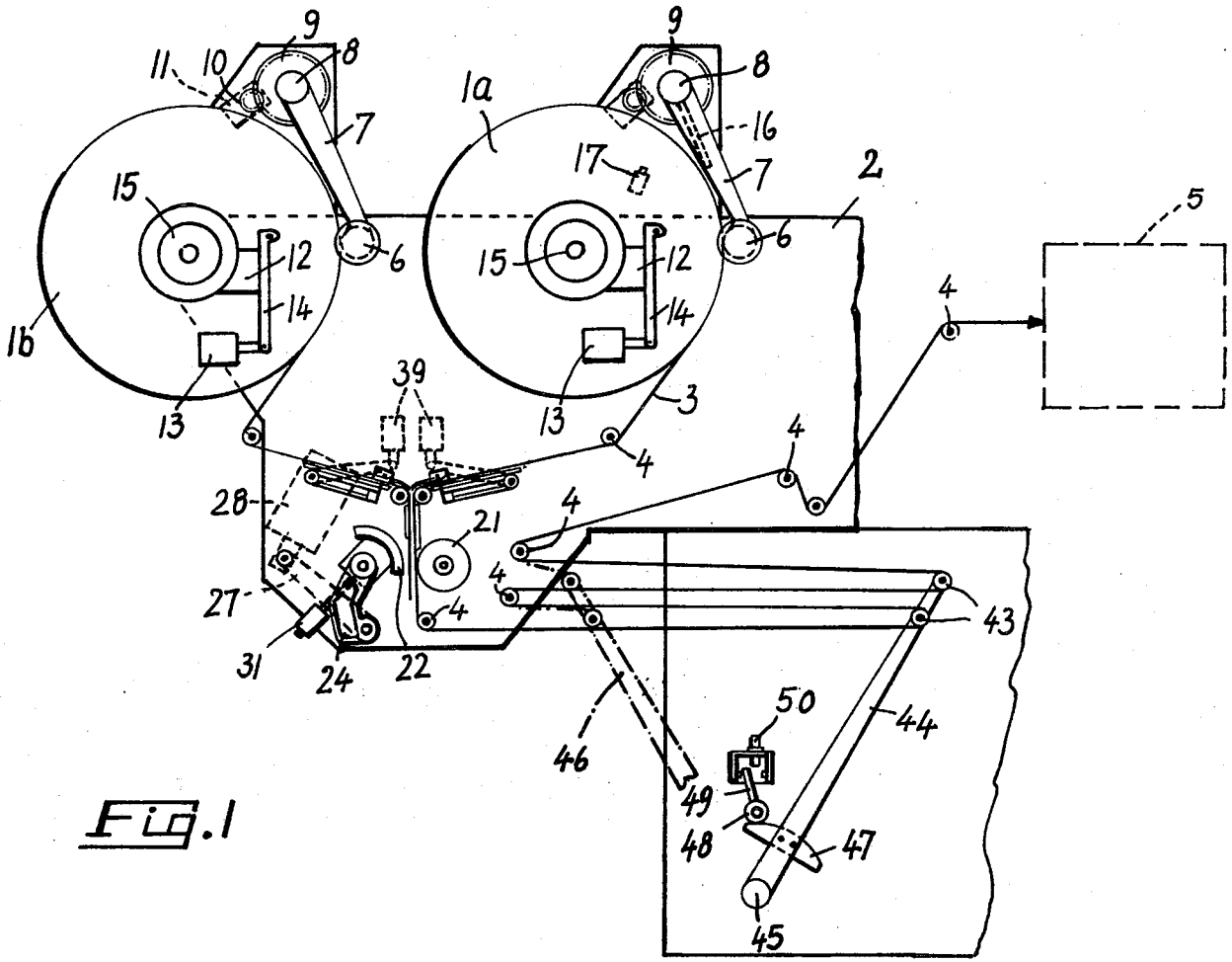
FIG. 1 is a schematic side view of the inventive apparatus.

From the coil 1*a*, the web denoted with the reference numeral 3 is transferred, in a manner known per se, through a plurality of rollers 4, having their axes parallel and horizontal, to a conveying machine, which in FIG. 1 is represented by the block 5 in dotted lines.

In order to keep the web 3 tensioned, rollers 6 bear upon the cylindrical surfaces of the coils 1*a* and 1*b* and are mounted at the ends of respective arms 7. The other ends 8 of the arms 7 are journal to the frame 2 of the apparatus. On each pivot, rigidly mounted for rotation with the arm 7, is mounted a gear wheel 9 which meshes with a pinion 10 driving a potentiometer 11 adapted to progressively vary the force applied by a brake 12, actuated by a solenoid 13 through a lever 14, upon the shaft 15 of the coils.

Also rigid with each arm 7, is a rod 16 monitoring, by interaction with an induction switch 17, the depletion of the web from the coil.

Below the two coils 1*a* and 1*b* is located a bonding station for bonding the edge 18 of a fresh coil yet to be unrolled (in Figure, the coil 1*b*), to the reserve tail end of the web 3 of the coil being exhausted (depleted coil 1*a*). At said station, the webs are guided and conveyed, through respective facing rollers 19, within vertical guides 20. Below such guides 20, there are arranged, on one side of the web path, a large diameter idle roller 21, and on the other side, a bonding cylindrical segment 22, also of considerable diameter, which is pivotally mounted, by means of a bracket 23, to the upper end of a suitably shaped arm 24. The lower end of the arm 24 is keyed to a pin 25 carried pivotally in a bushing 26 of the frame 2, to which pin 25 a lever 27 is also keyed. The rotation of lever 27 is effected by a solenoid 28.

Figure 2:
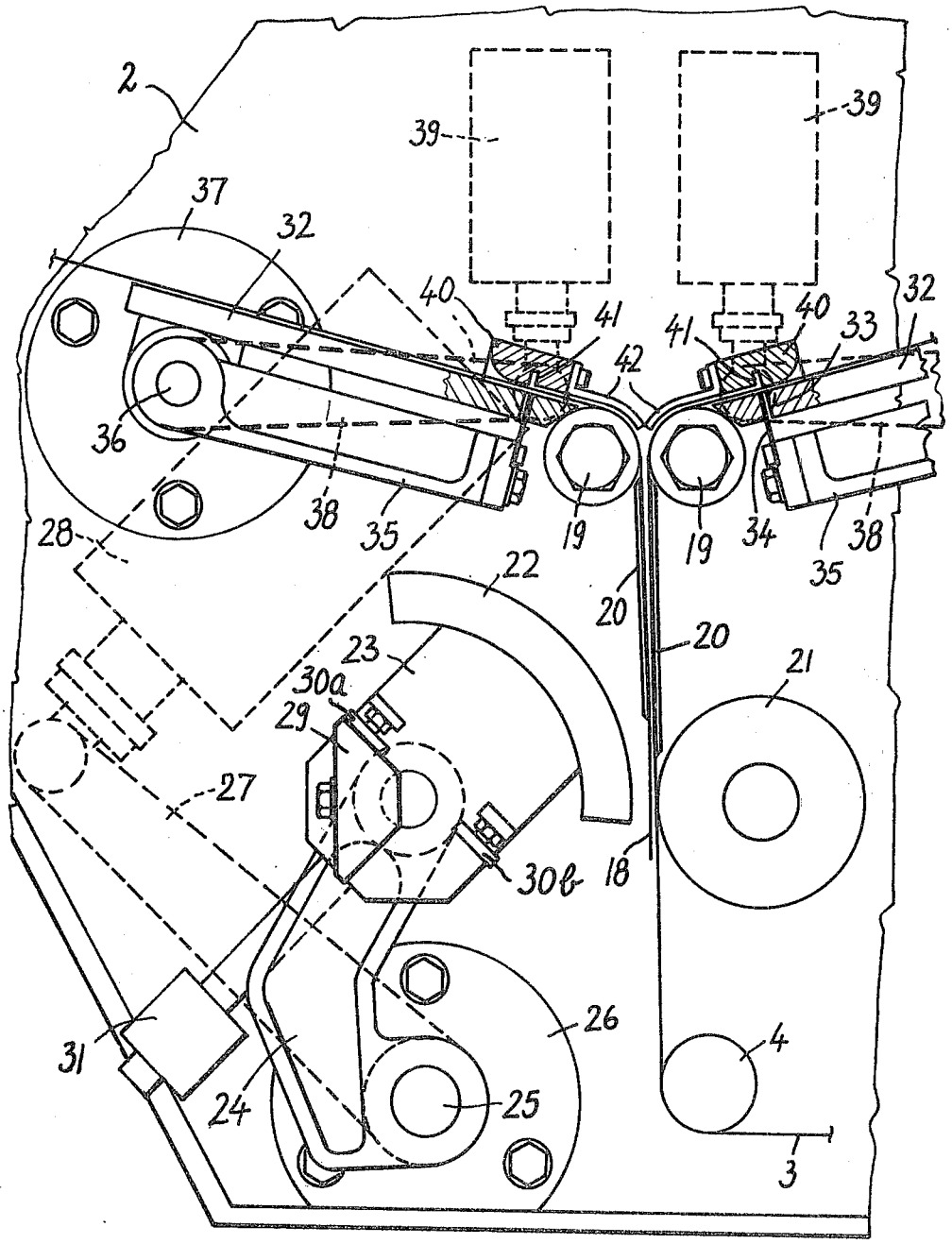
FIG. 2 is an enlarged, more detailed, view of the apparatus bonding station.

It should be noted that those parts which in FIGS. 1 and 2 are shown in dotted lines are located at the rear of the frame 2 which, in actual practice, consists of a suitably ribbed vertical wall.

A bracket 29 is also attached to the arm 24 and has orthogonal faces which alternately contact a pair of stops 30*a* and 30*b* attached to the bracket 23 of the cylindrical segment 22 and diametrically aligned with respect to the latter axis of rotation. The cylindrical segment 22 is held raised, in its rest condition, with the stop 30*a* against the bracket 29, by a counterweight 31.

Upstream of the bonding station, just before the rollers 19, there are arranged on one side and on the other respective web cutting means, comprising each a plate 32 whereon the web is caused to rest and slide, which plate has a transverse slot 33 adapted to allow a cutting blade 34 to pass therethrough. The cutting blade is secured to the end of an arm 35 located below the plate 32. The arm 35 is rigid, at its other end, with a pin mounted pivotally in a bushing 37 which is flange-connected to the frame 2. The arms 35 may be actuated, through respective levers 38, by means of respective solenoids 39. Facing each plate 32 is a block 40 in the bottom or lower face thereof is formed a transverse groove 41 in alignment with the slot 33, such as to allow the blade 34 to penetrate therethrough and cut the web 3. Also guides 42 are attached to the blocks 40 to redirect the web between the rollers 19.

Upon exiting the bonding station, the web 3 being unrolled is first wound around one of said rollers 4, located below the roller 21, such that the web is substantially tangent to the latter. After leaving the first roller 4, the web is wound sequentially and alternatively between a plurality of oscillating rollers 43 and as many fixed rollers 4. The oscillating rollers 43, two in number in FIG. 1, are mounted to the free end of a rod 44 which is keyed, at its other end, to a pin 45 carried pivotally by the frame 2. Thus it can travel angularly as far as the position 46, shown in dash-and-dot lines in FIG. 1, at which position the rollers 43 are in close proximity of the rollers 4.

To the rod 44, at the lower portion thereof, is attached a circular segment 47 upon which rests a roller 48 provided with a radial rod 49 which is movable between two travel limits and effective to influence the switch 50 to which are linked the solenoids 13 pertaining to the brakes 12.

The apparatus just described operates as follows. After the coils 1*a* and 1*b* have been installed on their shafts 15, one of them, e.g. the coil 1*a*, in the instance of FIG. 1, is unrolled and led, through the rollers 4, to the packaging machine. As the paper web 3 is being used, its related arm 7 carrying the resting roller 6 is lowered and, accordingly, the monitoring rod 16.

When the web on the coil is nearly exhausted, the rod 16 trips the switch 17 which, in turn, actuates the solenoid 28 of the bonding station. The solenoid 28 causes, through the lever 27, the arm 24 to rotate about the pin 25 until the cylindrical segment 22 is brought into contact with the idle roller 21. Thus, the web 3 from the coil 1*a* nearing exhaustion and the leading end edge 18 of the coil 1*b*, previously arranged between the vertical guides 20, are gripped between the cylindrical segment 22 and idle roller 21.

Simultaneously with the gripping of the two web edges between the cylindrical segment 22 and idle roller 21, the cutting of the web 3 from the coil 1*a* is carried out by the respective cutting blade 34 attached to the arm 35 which is actuated by the solenoid 39.

The forward movement of the web causes the cylindrical segment 22 to rotate about its axis, and correspondingly so the idle roller 21 cooperating therewith, which is accompanied by a rolling action onto the two web edges in contact and bonding thereof to each other.

The rotational movement proceeds until the stop 30*b* abuts the bracket 29, thus casting actuation of a switch, not shown, which energizes the solenoid 28 to return the arm 24 to its rest position, or in other words, the cylindrical segment 22 to move away from the roller 21.

The counterweight 31 restores instead the cylindrical segment 22 to its starting position, the stop 30*a* abutting the bracket 29.

At this time, after the tail end edge of the coil being exhausted 1*a* has been bonded to the leading one of the coil 1*b*, the operator replaces the deleted coil 1*a* with a fresh one.

This result is obtained without ever interrupting the web unrolling or feed at any point. In fact, as the segment 22 follows the forward movement of any web 3, the web slow down during the bonding step is effectively compensated by the displacement of the rod 44 to the position 46. In the proximity to said position, the switch 50 releases the action of the brake 12 to free the coil and allow the rod 44 to return to its starting position as well as to form a web reserve which will be utilized at the subsequent bonding step.

Particularly advantageous is also the adjustment by means of the potentiometers 11, thereby the operative conditions and the tension in the web being unrolled are at all times kept strictly constant.

The invention described hereinabove is susceptible to many modifications and variations, all of which fall within the scope of the instant inventive concept. Thus, for example, the idle roller 21 may be replaced by a second cylindrical segment, symmetrical to the segment 22, and equipped with a similar control device.

I claim:

1. In an apparatus for feeding a web continuously to a device and comprising a support frame receiving a supply coil and a reserve coil of web material, means for withdrawing web material from said coils, a bonding station for securing a trailing end of web material from said supply coil to a leading end of material from said reserve coil, and means for cutting web material upstream of said bonding station, the improvement wherein said bonding station is adapted to seal said ends together without stopping of the feed of the web to said device and comprises:

an arm angularly oscillatable about an axis parallel to said web material at said bonding station and pivotably mounted on said frame;

a bonding cylindrical segment carried by said arm and swingable thereby into engagement with said web material to press said ends together and seal them to one another, said segment being disposed on one side of said web;

an angularly displaceable member on said frame on the opposite side of said web juxtaposed with said segment and formed with a cylindrical surface rollingly engageable with said web upon the pressing thereof by said segment against said surface;

means for guiding said end between said segment and said surface tangentially to said surface; and control means operative to swing said cylindrical segment toward said surface in order to press said ends together between said segment and said surface with said segment and said surface rolling on said web to effect the bonding of said ends without stopping of said web, said segment being rotatable between two positions defined by respective stops mounted on a bracket connected to said segment for swinging same into one of said positions wherein said segment is out of engagement with said web.

2. The improvement defined in claim 1 wherein said improvement is an idler roller formed with said cylindrical surface.

3. In an apparatus for feeding a web continuously to a device and comprising a support frame receiving a supply coil and a reserve coil of web material, means for withdrawing web material from said coils, a bonding station for securing a trailing end of web material from said supply coil to a leading end of material from said reserve coil, and means for cutting web material upstream of said bonding station, the improvement wherein said bonding station is adapted to seal said ends together without stopping of the feed of the web to said device and comprises:

an arm angularly oscillatable about an axis parallel to said web material at said bonding station and pivotably mounted on said frame;

a bonding cylindrical segment carried by said arm and swingable thereby into engagement with said web material to press said ends together and seal them to one another, said segment being disposed on one side of said web;

an angularly displaceable member on said frame on the opposite side of said web juxtaposed with said segment and formed with a cylindrical surface rollingly engageable with said web upon the pressing thereof by said segment against said surface;

means for guiding said end between said segment and said surface tangentially to said surface; and control means operative to swing said cylindrical segment toward said surface in order to press said ends together between said segment and said surface with said segment and said web to effect the bonding of said ends without stopping of said web, the means for cutting the web material comprising for each coil:

a plate upon which the respective web material rests and slides and formed with a transverse cutting slot;

a cutting blade displaceable in said slot for severing the web material sliding along said plate;

a further arm disposed below said plate and connected to said blade for shifting same;

actuating means connected to said arm for oscillating same; and a block disposed above said plate and formed with a groove aligned with said slot and receiving said blade during the cutting of web material thereby.

4. In an apparatus for feeding a web continuously to a device and comprising a support frame receiving a supply coil and a reserve coil of web material, means for withdrawing web material from said coils, a bonding station for securing a trailing end of web material from said supply coil to a leading end of material from said reserve coil, and means for cutting web material upstream of said bonding station, the improvement wherein said bonding station is adapted to seal said ends together without stopping of the feed of the web to said device and comprises:

an arm angularly oscillatable about an axis parallel to said web material at said bonding station and pivotably mounted on said frame;

a bonding cylindrical segment carried by said arm and swingable thereby into engagement with said web material to press said ends together and seal them to one another, said segment being disposed on one side of said web;

an angularly displaceable member on said frame on the opposite side of said web juxtaposed with said segment and formed with a cylindrical surface rollingly engageable with said web upon the pressing thereof by said segment against said surface;

means for guiding said end between said segment and said surface tangentially to said surface; and control means operative to swing said cylindrical segment toward said surface in order to press said ends together between said segment and said surface with said segment and said surface rolling on said web to effect the bonding of said ends without stopping of said web; and means for compensating speed variations in the feed of web material, comprising:

a plurality of idler rollers fixedly positioned on said frame, a further arm swingable on said frame, and a plurality of idler rollers on said arm said web being passed alternately around idler rollers fixedly positioned on said frame and mounted on said further arm whereby the idler rollers on said further arm can approach the fixedly positioned idler rollers for speed compensation.

5. In an apparatus for feeding a web continuously to a device and comprising a support frame receiving a supply coil and a reserve coil of web material, means for withdrawing web material from said coils, a bonding station for securing a trailing end of web material from said supply coil to a leading end of material from said reserve coil, and means for cutting web material upstream of said bonding station, the improvement wherein said bonding station is adapted to seal said ends together without stopping of the feed of the web to said device and comprises:

an arm angularly oscillatable about an axis parallel to said web material at said bonding station and pivotably mounted on said frame;

a bonding cylindrical segment carried by said arm and swingable thereby into engagement with said web material to press said ends together and seal them to one another, said segment being disposed on one side of said web;

an angularly displaceable member on said frame on the opposite side of said web juxtaposed with said segment and formed with a cylindrical surface rollingly engageable with said web upon the pressing thereof by said segment against said surface;

means for guiding said end between said segment and said surface tangentially to said surface; and control means operative to swing said cylindrical segment toward said surface in order to press said ends together between said segment and said surface with said segment and said surface rolling on said web to effect the bonding of said ends without stopping of said web;

a respective roller at an end of a further arm bearing on each of said coils and swingably mounted by said further arm on said frame; and respective brakes acting on a shaft of each of said coils and responsive to the positions of the respective further arms for controlling the tension of web material drawn off the respective coil.

* * * * *